US005161595A

United States Patent [19]

Garat

[11] Patent Number: 5,161,595

[45] Date of Patent: Nov. 10, 1992

[54] PROCESS FOR THE LOST FOAM CASTING, UNDER LOW PRESSURE, OF ALUMINIUM ALLOY ARTICLES

[75] Inventor: Michel Garat, St. Etienne de Crossey, France

[73] Assignee: Aluminium Pechiney, Courbevoie, France

[21] Appl. No.: 690,645

[22] Filed: Apr. 24, 1991

[30] Foreign Application Priority Data

Jun. 7, 1990 [FR] France ..... 90 07736

[51] Int. Cl.[5] ..... B22C 9/04; B22D 21/04; B22D 27/13

[52] U.S. Cl. ..... 164/34; 164/120

[58] Field of Search ..... 164/34, 120

[56] References Cited

U.S. PATENT DOCUMENTS 4,139,045 2/1979 Vitt ..... 164/34

FOREIGN PATENT DOCUMENTS 2606688 5/1988 France ..... 164/34

64-34573 2/1989 Japan ..... 164/34

*Primary Examiner*—J. Reed Batten, Jr.

*Attorney, Agent, or Firm*—Dennison, Meserole, Pollack & Scheiner

[57] ABSTRACT

A pattern of an aluminum alloy article made from a foam of an organic substance. The pattern is immersed in a mold of dry sand containing no binder. The mold is filled with molten aluminum alloy from a feeder zone and the alloy is allowed to solidify, thereby creating at least one critical zone in which solidification takes place last. Before the solidified fraction of metal exceeds 40% by weight, an isostatic gas pressure is applied to the mold. The aluminum alloy has a solidification range higher than 30° C. and a ratio R of the distance between the feeder zone and at least one critical zone to half the means thickness of the article over this distance is greater than 10. The isostatic gas pressure being applied is between 0.1 and 0.5 MPa.

3 Claims, 2 Drawing Sheets

PROCESS FOR THE LOST FOAM CASTING, UNDER LOW PRESSURE, OF ALUMINIUM ALLOY ARTICLES

BACKGROUND OF THE INVENTION

The invention relates to a process for the lost foam casting, under low pressure, of metallic articles of aluminium alloy and constitutes an improvement to the process as described in French patent No. 2606688 filed on Nov. 17, 1986.

A person skilled in the art knows, for example from the teaching of U.S. Pat. No. 3 157 924, to use, for the casting of metals, patterns made of a foam of organic substance such as polystyrene which is immersed into a mould formed by dry sand containing no binder. Industrially, these patterns are generally coated with a film of refractory material intended to improve the quality of the castings. In such a process, the metal to be cast, which has previously been melted, is brought into contact with the pattern by means of a feed orifice and channels traversing the sand and gradually replaces said pattern by burning it and transforming it mainly into vapour which escapes between the grains of sand, hence the designation of the process as a lost foam casting process.

In comparison with conventional casting in a non-permanent mould, this technique obviates the prior manufacture, by compacting and agglomeration of powdered refractory materials, of rigid moulds connected in a fairly complicated manner to cores and allows easy recovery of the castings and simple recycling of the casting materials.

It is therefore simpler and more economical than the conventional technique. Furthermore, it offers greater freedom to the designers of castings with regard to the shape of said castings. This is why this technique has been found increasingly attractive from the industrial point of view. However, it is handicapped by several drawbacks, of which two result from conventional metallurgical mechanisms, that is:

the relative slowness of solidification which promotes the formation in the castings obtained of blowholes originating from the hydrogen dissolved in the liquid aluminium alloy the relative weakness of the thermal gradients which promotes the formation of microshrinkage despite the presence of feeders.

With the object of avoiding such drawbacks, it has previously been proposed, in French patent No. 2606688, to apply to the mould, after filling and before the solidified fraction of the metal exceeds 40% by weight, an isostatic gas pressure having a maximum value of between 0.5 and 1.5 MPa.

Therefore, the process according to this prior French patent comprises the conventional stages of lost foam casting, that is:

employing a pattern of the article to be cast formed from a foam of organic substance coated with a film of refractory material;

immersing said pattern in a mould formed from dry sand without binder;

filling the mould with molten metal to burn said pattern, this filling being carried out through a feed orifice connecting the pattern to the exterior of the mould;

evacuating the vapour and liquid residues emitted by said pattern during the combustion thereof;

allowing, the molten metal to solidify to obtain the article.

As an improvement in the French process, when the mould is completely filled, that is when the metal has completely replaced the pattern and the majority of the vapour has been evacuated, a gas pressure is applied to the mould; this operation can be carried out by placing the mould in a chamber capable of withstanding the pressure and connected to a source of gas under pressure.

This operation can be carried out immediately after filling while the metal is still completely liquid, but it can also take place later providing that the fraction of solid dendrites formed during solidification in the mould does not exceed 40%, the pressure only having a negligible effect beyond this value.

The maximum value of the pressure applied in this French process is preferably between 0.5 and 1.5 MPa.

Under these conditions, it is found that the quality of the articles obtained is improved and this phenomenon is explained by the following mechanisms:

compaction of the blowholes, of which the volume is reduced in practice in the ratio of the absolute pressures prevailing during solidification. Thus, for example, when an absolute pressure of 1.1 MPa is applied whereas this pressure was previously atmospheric pressure, that is 0.1 MPa, this reduction takes place in a ratio of about 11;

better supply of the mould since the pressure exerted on the still liquid feeders forces said liquid through the network of dendrites formed at the beginning of solidification and hence quasi elimination of microshrinkage.

However, it has been found in certain cases that the application of a relative pressure higher than 0.5 MPa led to the appearance of particular defects known as "spongy shrink holes" which is explained as follows: if the cast alloy has a relatively great solidification range, a pasty zone develops within the article; moreover, if the distance between the feeder and the location where the shrink hole occurs is great relative to the thickness of the article, the pasty zone creates a significant loss of charge over the metal supply to the mould with the result that the feeder itself cannot play its part under the influence of the external pressure, that is to say cannot sufficiently rapidly supply the shrink holes which are being formed.

As the solidification range is relatively great, the "skin" of the article (portion located at the metal/sand interface) is brittle for much longer and the external pressure exerted by the application of the gas on the sand therefore depresses this skin toward the interior of the article, allowing a fraction of gas to infiltrate between the dendrites toward the shrink holes and thus creating a so-called "spongy" shrink hole which is as harmful as the conventional shrink hole with regard to the obtaining of good mechanical properties.

Consequently, if articles are to be cast from an aluminium alloy having a relatively great solidification range and if the geometry of said articles leads to a relatively great distance between the feeder and the shrink hole zone known as the critical zone relative to their thickness, it is desirable to avoid these phenomena by eliminating the application of a pressure for example. However, it would be a pity to forgo this technique of casting under pressure which, moreover, leads to a considerable improvement in the quality of the castings.

SUMMARY OF THE INVENTION

To resolve this problem it is now proposed to apply a relative pressure below 0.5 which allows the spongy shrink hole to be eliminated while leading to good compaction of the blowholes.

As in French patent No. 2606688, the invention consists in a process for the lost foam casting of metallic articles, in particular of aluminium alloy, in which a pattern of the product to be obtained, made of a foam of organic substance, is immersed into a mould formed by a bath of dry sand containing no binder then, after having filled the mould with the molten metal and before the solidified fraction of metal exceeds 40% by weight, an isostatic gas pressure is applied to the mould, but this invention is characterised in that it is employed essentially for the casting of articles of aluminium alloy having a solidification range higher than 30° C. and of which the geometry is such that the ratio R of the length separating the feeder from the critical zone or zones over half the mean thickness of the article over this length is higher than 10 and the relative pressure applied is between 0.1 and 0.5 MPa.

Thus, the invention consists in an application of the basic process to aluminium alloy articles having a relatively great solidification range and possessing particular geometry such that the ratio R is higher than 10, that is to say where the distance L between the region in which solidification takes place at the last moment and the feeder is relatively great relative to the mean thickness e of the article over this distance.

This ratio is in fact the ratio of L over the module M of the portion of the article located between the feeder and the critical zone, the parameter used in casting which corresponds on average to half the thickness, that is e/2, hence $(L/M)=(L/(e/2))=2\ L/e$.

This ratio allows the value of the maximum pressure which can be applied without the risk of spongy shrink holes to be fixed: thus, the higher the ratio, the lower the value of the pressure. It has been found that, for a pressure of 0.5 MPa, the minimum value employed in French patent No. 2606688, R was close to 10. Therefore, when R is higher, it is necessary to employ a pressure lower than 0.5 MPa which can fall to 0.1 MPa, the pressure only having a negligible effect below this value, where it can be eliminated.

The invention is preferably applicable to alloys having a great solidification range such as, for example, Al—Cu, Al—Cu—Mg, Al—Zn—Mg, Al—Si—Cu—Mg alloys, as well as hypoeutectic Al—Si—Mg alloys of which the silicon content is preferably less than or equal to 9% by weight.

The invention can be illustrated by means of the accompanying drawings.

DESCRIPTION OF THE PREFERRED EMBODIMENT

Figure 1:
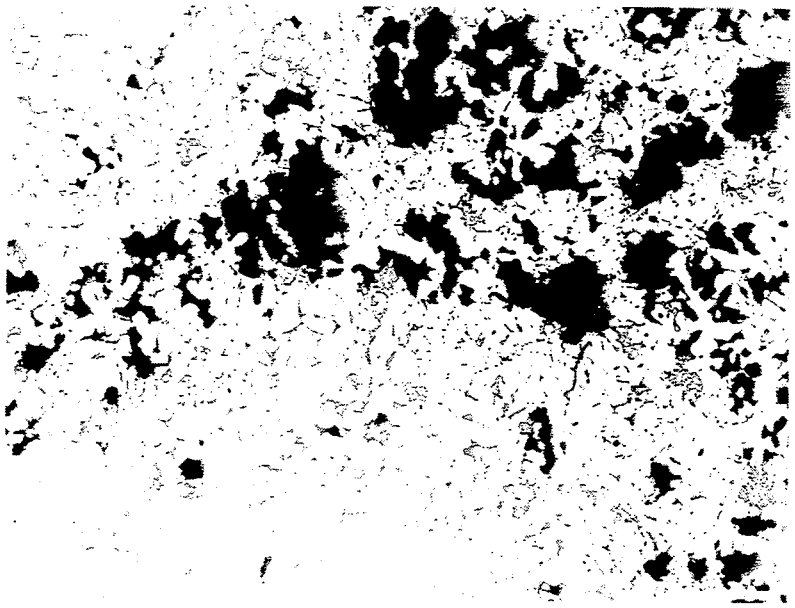
FIG. 1 is a photomicrograph of an article of AS5U3G alloy (composition, by weight, silicon 5%, copper 3%, magnesium 1%, remainder aluminium) in which R is equal to 15 and wherein the pressure applied during casting was 1.1 MPa.
Figure 2:
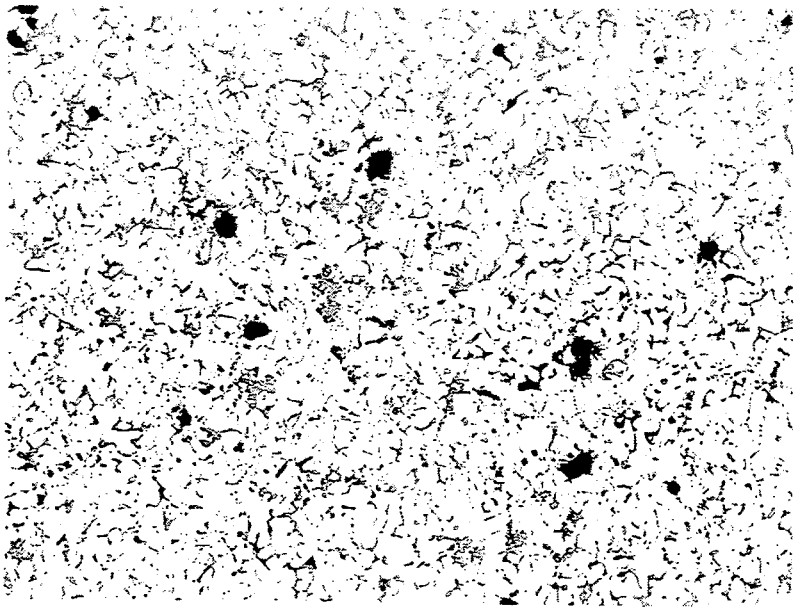
FIG. 2 is a photomicrograph of the same article but wherein the pressure applied was only 0.30 MPa.

FIG. 1 shows the presence of black zones corresponding to the infiltration of the dendrites by the gas and to the formation of spongy shrink holes, whereas these zones are virtually nonexistent in FIG. 2.

Cylinder heads of internal combustion engines were manufactured from the same aluminium alloy (AS-5U3G). These cylinder heads had two types of geometry, illustrated in FIGS. 3 and 4, and were respectively composed of a web 1 or 4, a bow 2 or 5 corresponding to the critical zone and a feeder 3 or 6. On each of these types, the dimensions of the critical zone were measured: the thickness e' and the width L', the dimensions of the web: the thickness e, the width L, and the ratio L/e and the value of R=L/M were determined. The cylinder heads of each type were divided into two batches and each batch was subjected either to a relative pressure of 0.3 MPa or to a relative pressure of 1.1 MPa during casting. After removal from the mould, the quality of the cylinder heads was checked with regard to spongy shrink holes. The results are compiled in Table 1.

It is found that no spongy shrink holes appear for a value of R=7.6 and whatever the pressure applied. The conventional process could therefore be applied to the cylinder heads in FIG. 3. On the other hand, spongy shrink holes appear below 1.1 MPa but not below 0.3 MPa in the cylinder heads shown in FIG. 4 where the ratio L/M is equal to 15.4. These cylinder heads should therefore be cast according to the process of the invention, in order to be serviceable.

The invention is applied, in particular, in the manufacture of cylinder heads of car engines and of all articles requiring high mechanical characteristics.

TABLE 1

Figure 4:
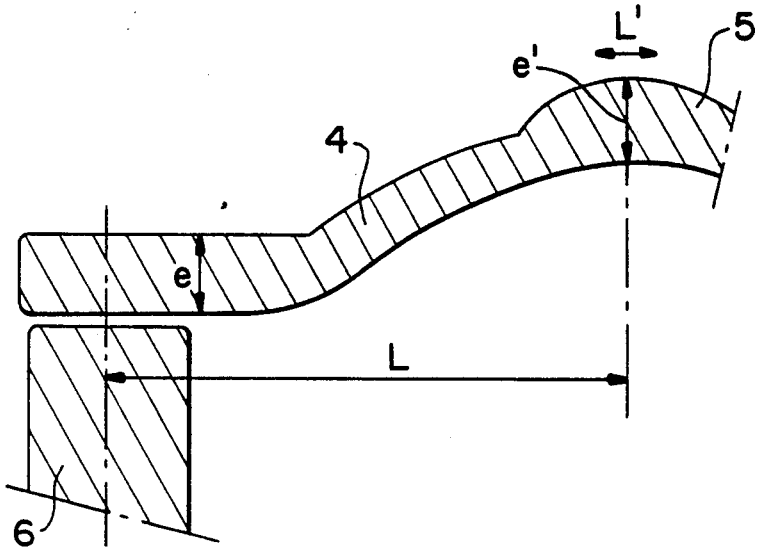
FIG. 4 shows in partial cross-section a cylinder head of an internal combustion engine where R=15.4, according to the invention.
Figure 3:
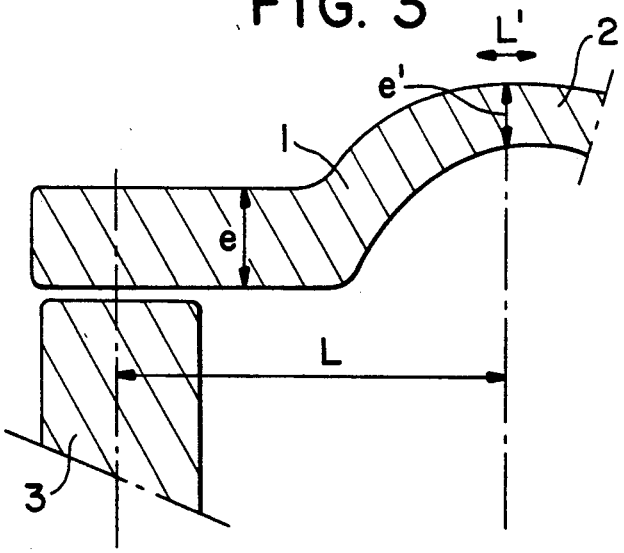
FIG. 3 is a partial cross-sectional diagram of a cylinder head of an internal combustion engine where R=7.6.

| Cylinder head | Dimensions of critical zone in cm | | Dimensions of web in cm | | | L/e | R = L/M | Pressure in MPa | Spongy Shrink holes |
|---|---|---|---|---|---|---|---|---|---|
| | Thickness e' | Width L' | Thickness e | Width L | Module M | | | | |
| FIG. 3 | 1 | 2 | 1.3 | 5 | 0.65 | 3.8 | 7.6 | 0.3 | None |
| | | | | | | | | 1.1 | None |
| FIG. 4 | 1 | 1 | 0.9 | 7 | 0.45 | 7.7 | 15.4 | 0.3 | None |
| | | | | | | | | 1.1 | Significant |

What is claimed is:

1. A process for lost foam casting of an aluminium alloy article, comprising:

obtaining a pattern of the article made of a foam of an organic substance;

immersing the pattern in a mold of dry sand containing no binder;

filling the mold from a feeder zone in the mold with molten aluminium alloy; and allowing the molten aluminium alloy to solidify, thereby creating at least one critical zone in which solidification takes place last; and before the amount of the aluminium alloy solidified exceeds 40% by weight, applying an isostatic gas pressure to the mold;

wherein the aluminium alloy has a solidification range higher than 30° C. and a ratio R of the distance between the feeder zone and the at least one critical zone to half the mean thickness of the article over said distance is greater than 10, and wherein the isostatic gas pressure applied is between 0.1 and 0.5 MPa.

2. Process according to claim 1, wherein the aluminium alloy is selected from the group consisting of Al—Cu, Al—Cu—Mg, Al—Zn—Mg, Al—Si—Mg and Al—Si—Cu—Mg alloys.

3. Process according to claim 1, wherein the pressure applied decreases as the ratio R increases.

* * * * *